US006106099A

United States Patent [19]

Mou et al.

[11] Patent Number: 6,106,099

[45] Date of Patent: Aug. 22, 2000

[54] PRINTHEAD WIPER FOR INK-JET PRINTER

[75] Inventors: Tse-Chi Mou, Taipei Hsien; Lin Yung Feng, Chung Ho Shih, both of Taiwan

[73] Assignee: DBTEL Incorporated, Taipei Hsien, Taiwan

[21] Appl. No.: 08/999,315

[22] Filed: Dec. 29, 1997

[51] Int. Cl.[7] ..... B41J 2/165

[52] U.S. Cl. ..... 347/33

[58] Field of Search ..... 347/33; 400/701, 400/702; 15/250.361, 250.41, 250.48

[56] References Cited

U.S. PATENT DOCUMENTS 5,151,715 9/1992 Ward et al. ..... 347/33

5,398,371 3/1995 Oyama ..... 15/250.41

*Primary Examiner*—Huan Tran

*Attorney, Agent, or Firm*—Merchant & Gould P.C.

[57] ABSTRACT

A unitary wiper for a printhead on a print cartridge in an ink-jet printer is disclosed. The wiper is made of an elastomeric material and includes a base mounted in the ink-jet printer, a beam having a pair of approximately opposed substantially planar surfaces each of which terminates in a first wiping edge at a first end of the beam and at the base at a second end of the beam, and a slot formed on the beam, and extending along the second end from a third end of the beam to a fourth end of the beam. The first end is a plane surface and the beam further has at the plane surface a second wiping edge opposed to the first wiping edge.

14 Claims, 4 Drawing Sheets

PRINTHEAD WIPER FOR INK-JET PRINTER

FIELD OF THE INVENTION

The present invention relates to an ink-jet printer and more particularly to an improved wiper for a printhead on such a printer.

BACKGROUND OF THE INVENTION

A prior ink-jet printer includes a service station at one end of the travel path of the printing carriage upon which the printing cartridge is mounted. The service station includes a wiper for wiping the printhead to remove contaminants, dried ink and the like from the printhead surface containing the nozzle openings. Referring now to FIGS. 1–3, there is shown a prior patent wiper 10 of the Hewlett-Packard Co., which includes a wiper beam 11 having a rectangular opening 12 for smoothly flexing when the wiper beam 11 is pushed by a print cartridge 13. Although that wiper 10 has a rectangular slot 12 sized and shaped to increase the deflection of wiper beam 11 as the printhead 14 of the print cartridge 13 is wiped by the wiper 10, there are some shortcomings about the wiper 10. Such as the concentration of stress breaking the structure of the wiper 10 would happen at the four corners of the rectangular opening 12 provided at the middle part of the wiper 10 and then areas around the four corners would crack, and it is difficult to manufacture by a model having an opening 12.

It is therefore tried by the applicant to deal with the above situation encountered by the prior art.

SUMMARY OF THE INVENTION

It is therefore an object of the present invention to provide a durable wiper for the print cartridge.

It is further an object of the present invention to provide a more flexible wiper beam.

It is additional an object of the present invention to provide a convenient model for the wiper.

According to the present invention, a unitary wiper for a printhead on a print cartridge in an ink-jet printer is made of an elastomeric material and includes a base mounted in the ink-jet printer, a beam having a pair of approximately opposed substantially planar surfaces each of which terminates in a first wiping edge at a first end of the beam and at the base at a second end of the beam, and a slot formed on the beam, and extending along the second end from a third end of the beam to a fourth end of the beam.

Preferably the first end is a plane surface and the beam further has at the plane surface a second wiping edge opposed to the first wiping edge.

Preferably the slot has a depth equal to approximately 10~30% of the depth of the beam.

Certainly the slot can have a depth preferably equal to 20.8% of the depth of the beam.

Certainly the slot can have a height equal to approximately four times the depth thereof.

Preferably the slot is substantially parallel to the beam.

Preferably the base includes a substantially planar upper surface with which the slot communicates.

Certainly the base can include an upper connection part and a lower part, and the former has a cross section bigger than the later's cross section.

Certainly the connection part and the lower part can have a rounded junction.

Preferably the wiping edge wipes the printhead's surface.

Preferably the base includes a grooved part.

Certainly the slot can be located on one of the planar surfaces.

Certainly a second slot can be located on the other one of the planar surfaces.

Preferably the slot has a depth of 0.25 mm and the beam has a depth of 1.2 mm.

The present invention may best be understood through the following descriptions with reference to the accompanying drawings, in which:

DETAILED DESCRIPTION OF THE PREFERRED EMBODIMENTS

Figure 1:
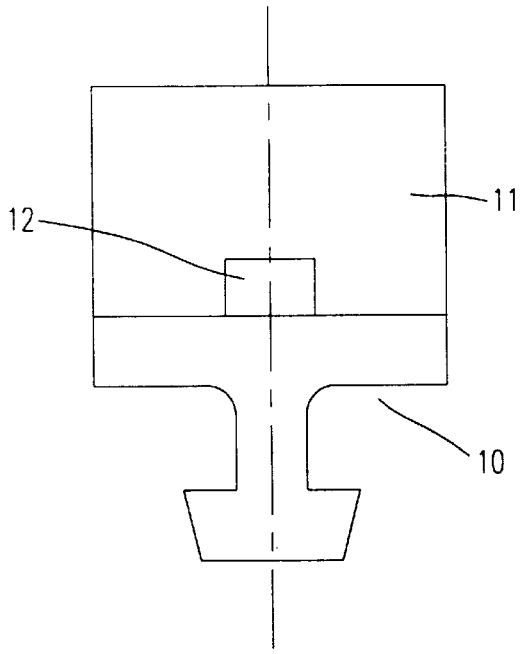
Fig. 1(PRIOR ART)
FIG. 1 is a front elevational view of a prior art wiper.
Figure 2:
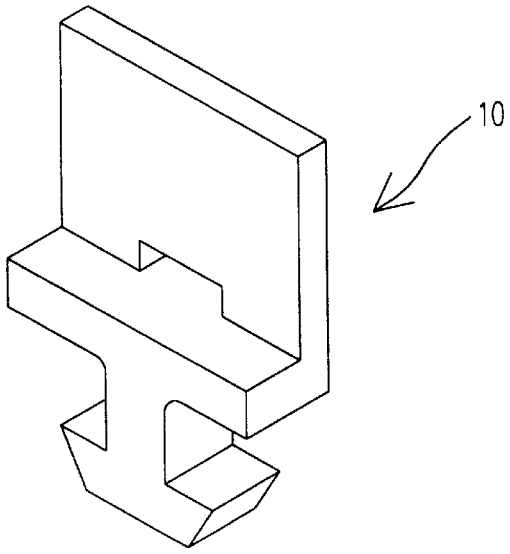
Fig. 2(PRIOR ART)
FIG. 2 is a perspective view of the conventional wiper of FIG. 1.
Figure 3:
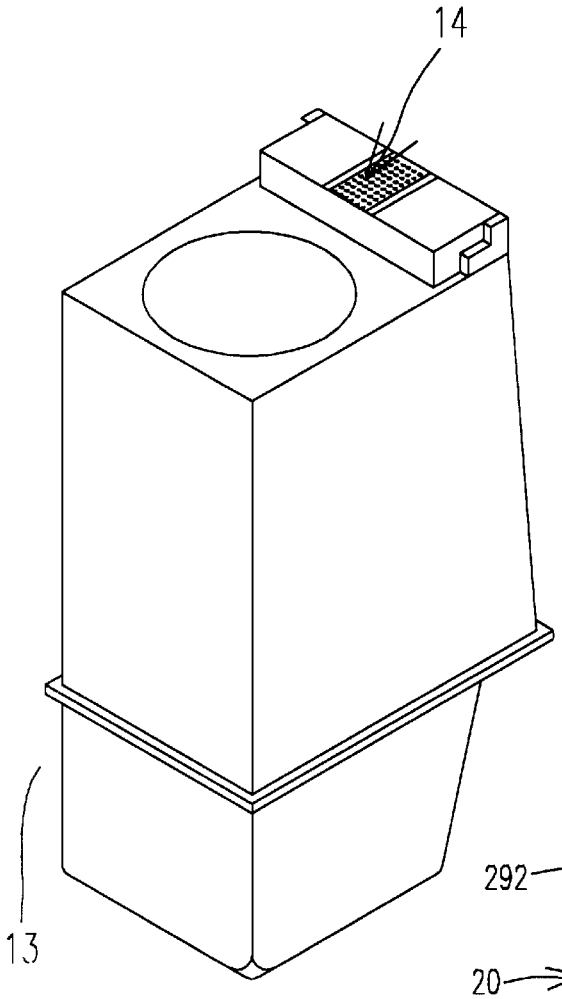
FIG. 3 is a perspective view showing a print cartridge having a printhead.
Figure 4:
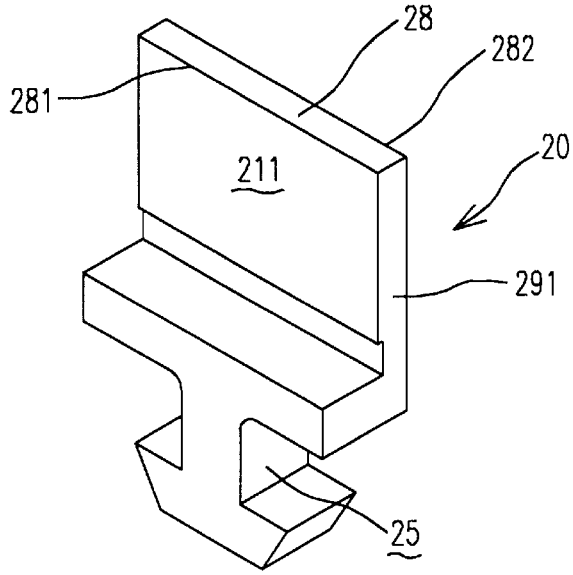
FIG. 4 is a perspective view of a preferred embodiment of a wiper for the printhead in FIG. 3 in accordance with the present invention.
Figure 5:
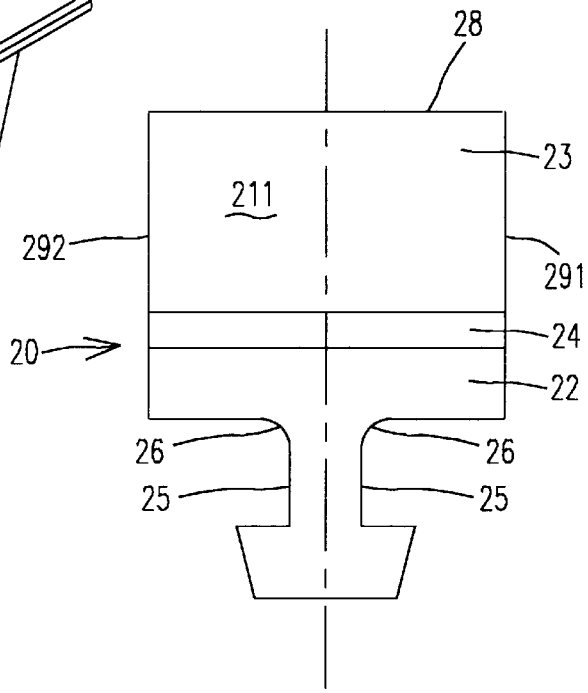
FIG. 5 is a front elevational view showing the wiper of FIG. 4.
Figure 6:
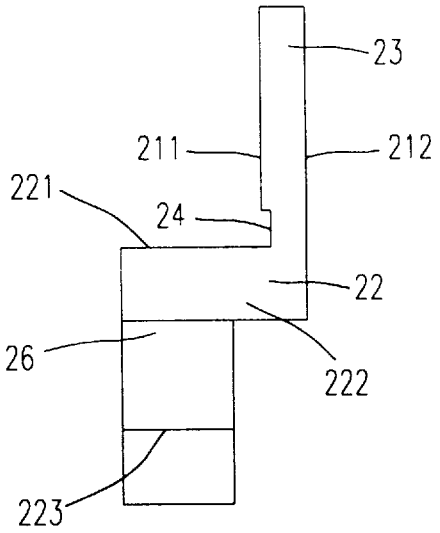
FIG. 6 is a side elevational view showing the wiper of FIG. 4.

Attention is now directed to FIGS. 4–6, in which there is shown a preferred embodiment of a unitary wiper 20 for a printhead 14 on a print cartridge 13 in FIG. 3 in an ink-jet printer. Wiper 20 is made of an elastomeric material and includes a base 22 mounted in the ink-jet printer, a beam 23 having a pair of approximately opposed substantially planar surfaces 211, 212 each of which terminates in a first wiping edge 281 at a first end 28 of the beam 23 and at the base 22 at a second end of the beam 23 (where the second end is integral with base 22), and a slot 24 formed on the beam 23, and extending along the second end from a third end 291 of the beam 23 to a fourth end 292 of the beam 23.

The first end 281 is a plane surface and the beam 23 further has at the plane surface a second wiping edge 282 opposed to the first wiping edge 281. The slot 24 has a depth equal to approximately 10~30% of the depth of the beam 23 and it can have a depth preferably equal to 20.8% of the depth of the beam 23. The slot 24 can have a height equal to approximately four times the depth thereof, and it is substantially parallel to the beam 23. The base 22 includes a substantially planar upper surface 221 with which the slot 24 communicates, and it can include an upper connection part 222 and a lower part 223 in which the former 222 has a cross section bigger than the later's 223 cross section. The connection part 222 and the lower part 223 can have a rounded junction 26. The wiping edges 281, 282 wipe the printhead's 14 surface. The base 22 includes a grooved part 25.

Figure 7:
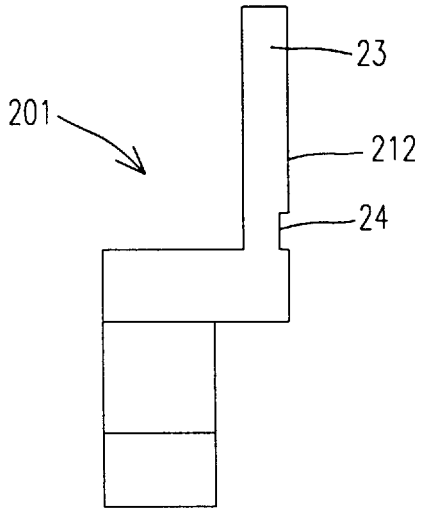
FIG. 7 is a side elevational view showing a second preferred embodiment of a wiper for the printhead of the invention.
Figure 8:
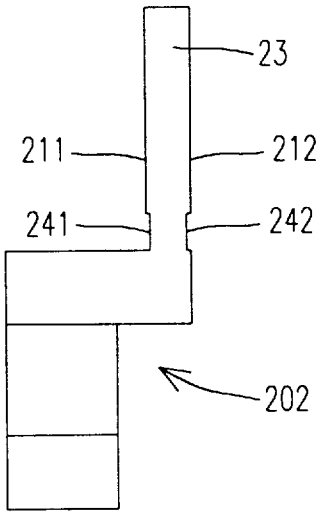
FIG. 8 is a side elevational view showing a third preferred embodiment of the invention.

Indicated generally at 201 and 202 in FIGS. 7 and 8 are for a more detailed consideration of the structure of a second and a third preferred embodiments of a wiper and of the manner in which it is mounted in the ink-jet printer in accordance with the present invention. We know that the slot 24 can be located on the other one 212 of the planar surfaces 211, 212. The slot 24 has a depth of 0.25 mm and the beam has a depth of 1.2 mm. Because the first slot 241 in FIG. 8 is shallower than the slot 24 in FIG. 6 or FIG. 7, there would be a second slot 241 located on the other one 212 of the planar surfaces 211, 212.

Figure 9:
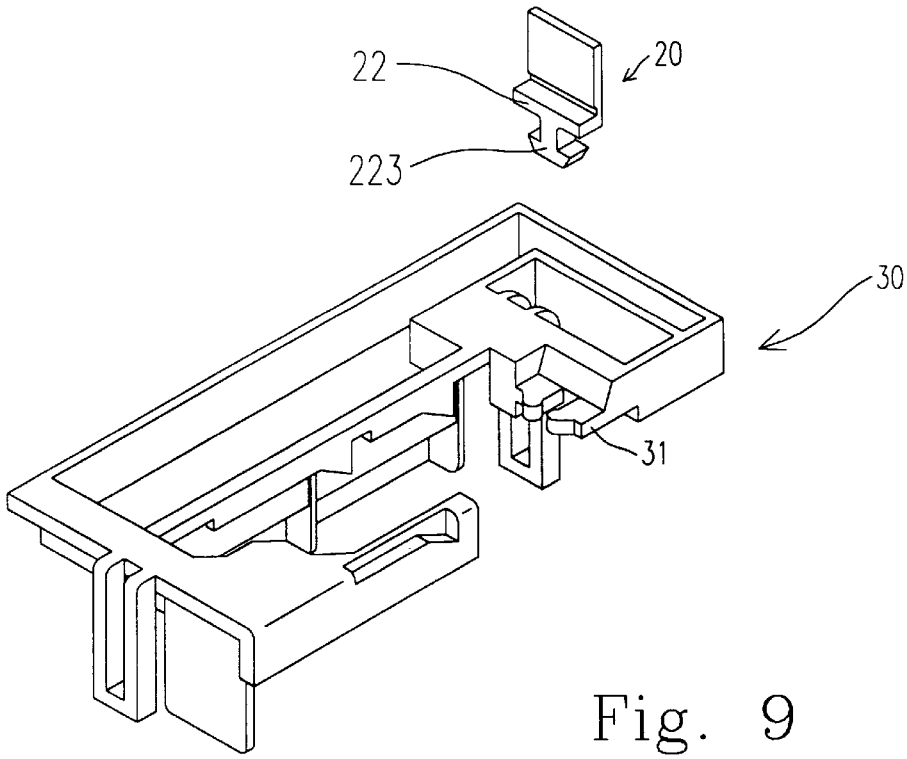
FIG. 9 is an exploded perspective view of a wiper and a carrier of the invention.
Figure 10:
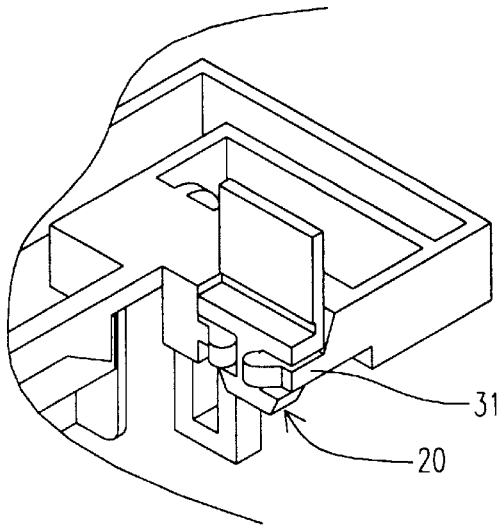
FIG. 10 is an enlarged view of FIG. 9 illustrating the wiper mounted on an associated bracket.

Turning now to FIGS. 9 and 10, indicated generally at 20 is a wiper constructed in accordance with the present invention. Carrier 30 includes a bracket 31 which cooperates with base 22 having the lower part 223 to securely mount wiper 20 on carrier 30 as illustrated in FIG. 10. As is the case with wiper 20 which is sufficiently elastomeric to be deformed to the extent that the vertical part of the lower part 223 can be inserted into and removed from bracket 31 without harm to the wiper 20. While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What we claim is:

1. A unitary wiper for a printhead on a print cartridge in an ink-jet printer, said wiper being made of an elastomeric material and comprising:

a base statically mounted in said ink-jet printer;

a beam having a pair of approximately opposed planar surfaces each of which terminates in a first wiping edge at a first end of said beam and at said base at a second end of said beam; and a slot formed in at least one of said planar surfaces of said beam, wherein the slot extends along said second end from a third end of said beam to a fourth end of said beam, wherein said slot has a height that is greater than the depth of said slot.

2. A wiper according to claim 1 wherein said first end is a plane surface and said beam further has at said plane surface a second wiping edge opposed to said first wiping edge.

3. A wiper according to claim 2 wherein said slot has a depth equal to approximately 10~30% of the depth of said beam.

4. A wiper according to claim 3 wherein said slot has a depth preferably equal to 20.8% of the depth of said beam.

5. A wiper according to claim 3 wherein said slot has a height equal to approximately four times the depth thereof.

6. A wiper according to claim 1 wherein said slot is substantially parallel to said beam.

7. A wiper according to claim 1 wherein said base includes a substantially planar upper surface with which said slot communicates.

8. A wiper according to claim 1 wherein said base includes a upper connection part and a lower part, and the former has a cross section bigger than the later's cross section.

9. A wiper according to claim 8 wherein said connection part and said lower part have a rounded junction.

10. A wiper according to claim 1 wherein said wiping edge wipes said printhead's surface.

11. A wiper according to claim 1 wherein said base includes a grooved part.

12. A wiper according to claim 1 wherein said slot is located on one of said planar surfaces.

13. A wiper according to claim 1 wherein a second slot is located on the other one of said planar surfaces.

14. A wiper according to claim 1 wherein said slot has a depth of 0.25 mm and said beam has a depth of 1.2 mm.

* * * * *